US007686290B2

(12) United States Patent
Potter

(10) Patent No.: US 7,686,290 B2
(45) Date of Patent: Mar. 30, 2010

(54) DOUBLE INHIBIT MECHANISM

(75) Inventor: Thomas C. Potter, Merrifield, VA (US)

(73) Assignee: United States Postal Service, Washington, DC (US)

( * ) Notice: Subject to any disclaimer, the term of this patent is extended or adjusted under 35 U.S.C. 154(b) by 38 days.

(21) Appl. No.: 11/902,389

(22) Filed: Sep. 21, 2007

(65) Prior Publication Data

US 2009/0078613 A1 Mar. 26, 2009

(51) Int. Cl.
*B65H 3/04* (2006.01)

(52) U.S. Cl. ..... 271/35; 271/121

(58) Field of Classification Search ..... 271/104, 271/34, 35, 121, 124, 137, 138
See application file for complete search history.

(56) References Cited

U.S. PATENT DOCUMENTS

| | | | | |
|---|---|---|---|---|
| 2,852,255 | A | 9/1958 | Fischer | |
| 3,219,339 | A * | 11/1965 | Gutierrez | 271/11 |
| 3,373,685 | A | 3/1968 | Adams | |
| 3,773,317 | A | 11/1973 | Kummerer | |
| 3,970,298 | A | 7/1976 | Irvine et al. | |
| 4,216,952 | A | 8/1980 | McInerny | |
| 4,313,598 | A | 2/1982 | DiBlasio | |
| 4,432,540 | A | 2/1984 | Akers et al. | |
| 4,555,103 | A * | 11/1985 | Larson | 271/35 |
| 4,579,332 | A * | 4/1986 | Larson | 271/35 |
| 4,615,519 | A | 10/1986 | Holodnak et al. | |
| 5,004,218 | A * | 4/1991 | Sardano et al. | 271/35 |
| 5,386,984 | A | 2/1995 | Dal Toso et al. | |
| 5,601,282 | A * | 2/1997 | Milo et al. | 271/35 |
| 6,241,235 | B1 | 6/2001 | Schmidt-Kretschmer | |
| 6,585,251 | B2 * | 7/2003 | Allen et al. | 271/121 |
| 6,971,645 | B2 * | 12/2005 | Coret et al. | 271/138 |
| 2003/0090051 | A1 * | 5/2003 | Allen et al. | 271/35 |
| 2003/0141650 | A1 | 7/2003 | Coret et al. | |
| 2006/0220299 | A1 * | 10/2006 | Kaiping | 271/35 |
| 2008/0099977 | A1 * | 5/2008 | Salomon et al. | 271/35 |

* cited by examiner

*Primary Examiner*—David H Bollinger
(74) *Attorney, Agent, or Firm*—Lewis and Roca LLP

(57) ABSTRACT

Described herein is a system and device for singulating mail pieces during mail processing and sorting. A double inhibit mechanism, mounted opposite a feed belt assembly and having at least two degrees of freedom at its downstream end, can maintain contact with mail in the mail path while separating overlapping mail pieces and allowing only single pieces to pass thereby.

28 Claims, 11 Drawing Sheets

DOUBLE INHIBIT MECHANISM

TECHNICAL FIELD

The present invention relates generally to apparatus and methods for processing mail and more particularly, the present invention relates to an apparatus for singulating mail from a stack as each piece is processed individually.

BACKGROUND

The conventional system by which mail is currently identified and processed (e.g., sorted) is highly automated, but still requires both human and mechanical operations. Human operations are initially required to load the mail from a mail delivery repository into a mechanical identification and processing system. Mechanical operations then attempt to identify the delivery address for each mail piece and, if successful, to then process each mail piece based on the delivery address. If there is a failure to identify the delivery address of a mail piece mechanically, human operators are required to identify the delivery address. Likewise, if there is a failure to process the mail piece based on the delivery address, human operators are again required to process the mail piece. As a result, conventional systems for identifying and processing mail must be reliable if the need for human operators and oversight is to be minimized.

A typical mail processing machine comprises a series of modules, components, and subassemblies which perform independent functions in the mail sorting process. For example, after the mail is collected, the sorting process typically begins with a Dual Pass Rough Cull System (DPRCS). As mail travels through the DPRCS, large items, such as packages and mail bundles, are removed from the mail stream. The remaining mail then enters an Advanced Facer-Canceler System (AFCS), the first machine for processing standard mail, where postage is cancelled. Pieces that pass through the DPRCS, but do not conform to physical dimensions for processing in the AFCS (i.e., over-sized items) are also diverted from the stream.

The mail remaining in the mail stream, or feed path, can then be fed past an optical character reader (OCR) or Bar Code Reader (BCR), which reads or scans the delivery address from the mail piece and causes a special code (e.g., a bar code), corresponding to the delivery address or other pertinent information, to be printed or "sprayed" on the mail piece. Once coded, the mail can be automatically sorted by a Delivery Bar Code System that reads the code and determines the destination postal station of the mail piece.

Typically, OCRs, BCRs, and other machines of the type described above are capable of operating at a rather high rate of speed, usually processing on the order of 100 to 400 pieces of mail per minute. At this rate, it is often crucial that the mail pieces enter the feed path of the mail processing machines one at a time and not overlapping one another.

If more than one mail piece is permitted to travel down the feed path at one time, several problems may arise. For example, an OCR or similar device may not be able to read the delivery address printed on a piece of mail if the address is eclipsed or otherwise obscured by an overlapping mail piece. Also, where a second mail piece is completely overlapping a first, the address on the second piece may be scanned and that information may be inadvertently sprayed on the back of the first mail piece, resulting in a missort. Additionally, overlapping mail pieces can lead to paper jams and excessive wear on the sorting components. This results in machine down-time and the need for costly and time consuming repairs.

Thus, "double inhibit" mechanisms are commonly employed within item handling machinery, such as mail processing machines, in an attempt to ensure that only single items are traveling down the handling path, past the various modules or components. Although the following discussion is generally directed to double inhibit mechanisms in mail processing machinery, the invention is not so limited, and may be employed in other types of item handling machinery.

The double inhibit mechanism may include friction elements placed opposite the feed belts of the mail processing machine. The coefficient of friction existing between the friction elements and a mail piece is typically less than that found between the feed belts and a mail piece, but greater than that found between two mail pieces. As a result, when two pieces of mail pass between the friction elements and the feed belts, the friction element may contact the second mail piece and the frictional forces therebetween, which are greater than those between the two mail pieces, will prevent it from passing by. But when only one piece passes between the feed belts and the double inhibit mechanism, the friction between the mail piece and the feed belt is great enough to overcome any frictional forces imparted by the device's friction elements and the mail piece is able to continue down the mail path.

Unfortunately, friction elements currently in use are not always reliable. Occasionally, as a mail piece traveling down the mail path attempts to move past the friction elements of a double inhibit mechanism, the mail piece's striking of the friction element can cause the friction element to "bounce" or lose contact with the mail as it travels down the mail path. When contact with the mail is disrupted, the chance for overlapping mail pieces to make their way past the double inhibit mechanism is greatly increased.

Accordingly, it is desirable to provide an improved double inhibit mechanism which addresses the shortcomings set forth above.

SUMMARY

A double inhibit mechanism for use in the processing of items. The mechanism comprises a mounting frame and a friction element having an upstream end, a downstream end, and a working surface. The working surface defines one side of an item feed path. The double inhibit mechanism also comprises a biasing mechanism mechanically biasing the friction element towards the feed path. Additionally, the friction element can be mechanically coupled to the mounting frame such that the downstream end has at least two degrees of freedom.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION

Disclosed herein are various systems and devices for separating, or singulating, mail pieces as they are processed through a mail sorting system. Generally, the systems can include a supply table, one or more feed belts, a double inhibit mechanism, and one or more take-away belts. In one aspect, the double inhibit mechanism acts to separate overlapping mail pieces that may pass from the supply table to the feed belts during mail processing and sorting.

Devices and systems disclosed herein may incorporate one or more friction elements having both an upstream and downstream end. The downstream end may exhibit an additional degree of freedom, being capable of both rotation and translation. This second degree of freedom may allow the downstream end of the friction element to move into the mail path and maintain contact with mail in the mail path, regardless of any bounce experienced at the upstream end. Thus, instances of overlapping mail pieces passing the double inhibit mechanism may be greatly reduced.

Reference will now be made in detail to exemplary embodiments consistent with the invention, examples of which are illustrated in the accompanying drawings. Wherever possible, the same reference numbers will be used throughout the drawings to refer to the same or like parts.

Figure 1:
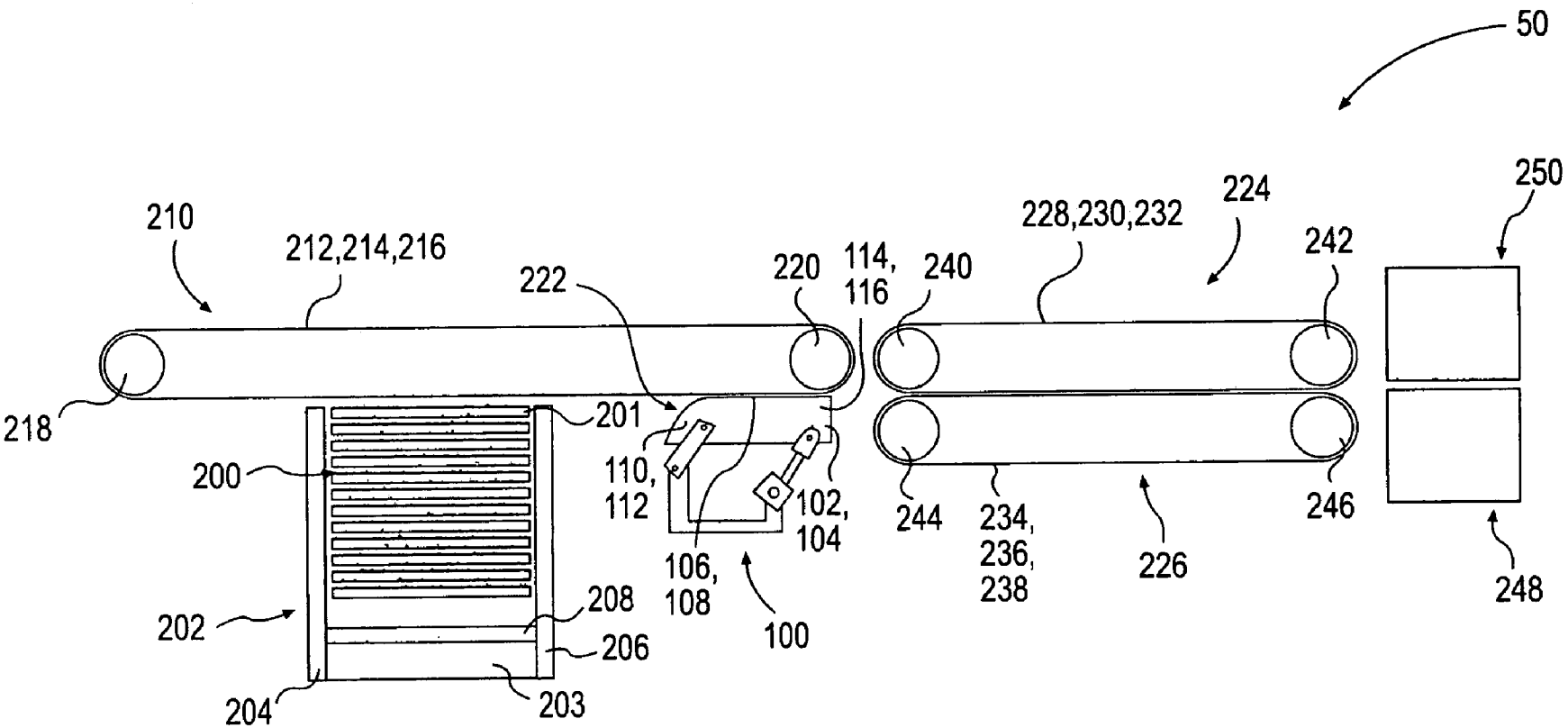
FIG. 1 is a top view of one exemplary embodiment consistent with the invention.

Referring now to FIG. 1, there is shown one embodiment of a mail sorting system 50 comprising a supply table 202, a feed belt assembly 210, a double inhibit mechanism 100, a pair of take-away belt assemblies 224 and 226, and two mail processing components 248 and 250.

In one aspect of this embodiment, supply table 202 can comprise a bottom wall 203 and a pair of guide rails, 204 and 206. Between the guide rails, a stack of mail pieces 200, horizontally stacked with an edge of each piece being supported by lower wall 203, can be pushed towards feed belt assembly 210 by a movable paddle 208. Paddle 208 may be mechanically biased towards the feed belt assembly such that it is applying constant force on stack 200 in the direction of feed belt assembly 210. For example, paddle 208 may be spring-biased towards feed belt assembly 210.

In one aspect, feed belt assembly 210 can be comprised of three belts 212, 214, and 216 in stacked configuration and positioned on rollers 218 and 220. There need not be three feed belts, however. For example, in other embodiments, feed belt assembly 210 may be comprised of one, two, or more feed belts. Further, there need not be only two rollers. In another aspect, as depicted in FIG. 1, feed belts 212, 214, and 216 can be oriented substantially perpendicular to supply table 202 and can be comprised of a variety of materials, including, but not limited to, cork, rubber, or polyurethane. Feed belts used in document transportation and sorting are commonly known in the art, as are the materials from which they may be made. Many of these belts or assemblies can be incorporated into the system described herein.

Feed belt assembly 210, in this embodiment, is rotating in a counter-clockwise direction. In other embodiments and configurations, these belts, along with rollers 218 and 220, may rotate clockwise. In one aspect, paddle 208 forces mail stack 200 against feed belts 212, 214, and 216 such that a leading piece of mail 201 comes into contact with the belts. Between feed belts 212, 214, and 216 and mail piece 201 there exists a coefficient of friction, which, in light of the normal force exerted by paddle 208, can result in a frictional force on mail piece 201 sufficient to carry it down mail path 222, along feed belts 212, 214, and 216. This coefficient of friction may be in the range of 0.9 to 1.3, but will depend on the material used for feed belts 212, 214, and 216 and the paper or material comprising the mail piece or other document. The removal of a mail piece from supply table 202 allows paddle 208 to converge on feed belts 212, 214, and 216, thus pushing the next piece of mail against feed belt assembly 210, and so on.

Paddle 208 can be movably coupled to supply table 202 in a variety of ways. For example, paddle 208 may slide along guide rails 204 and 206 via a slot and rail connection. Alternatively, paddle 208 may have a tooth extending from its downward facing edge, extending through an elongated slot in bottom wall 203. Similar paddle and supply table systems are well known in the art, as are many alternative configurations, many of which may be used in conjunction with the system described herein.

In another aspect, a mail piece transported by feed belt assembly 210, such as mail piece 201, may then pass between feed belts 212, 214, and 216 and double inhibit mechanism 100. More specifically, in one aspect, mail piece 201 may pass between the feed belts and a pair of friction elements, 102 and 104, of double inhibit mechanism 100, which can be maintained in a stacked configuration. In other embodiments, double inhibit mechanism 100 may comprise a number of friction elements other than two. Further, the friction elements can be mechanically biased towards mail path 222 such that they exert a normal force on the mail pieces passing thereby.

In another aspect, friction elements 102 and 104 may each comprise a working surface, 106 and 108, respectively, that faces mail path 222 and makes contact with passing mail pieces. Friction elements 102 and 104 can be comprised of a variety of materials, including, but not limited to, cork, rubber, polyurethane, or stone. Alternatively, of course, other suitable materials may be used.

Between working surfaces 106 and 108 and the mail pieces in the mail path, there exists a coefficient of friction, which, in light of the normal force exerted on the mail by friction elements 102 and 104, results in a frictional force acting on the mail piece in a direction opposite the flow of mail path 222. The coefficient of friction may be in the range of 0.6 to 1.2, but will depend on the material used for friction elements 102 and 104 and the paper or material comprising the mail piece or other document in mail path 222. Specifically, it should be less than the coefficient of friction found between the mail piece and feed belts 212, 214, and 216, but greater than the coefficient of friction between two mail pieces.

In one aspect, friction elements 102 and 104 can each have an upstream end, 110 and 112, respectively. Upstream ends 110 and 112 can have a degree of freedom such that when a single mail piece, traveling along feed belts 212, 214, and 216, contacts working surfaces 106 and 108, friction elements 102 and 104 can move in a direction away from the mail path, allowing the mail piece to come into contact with working surfaces 106 and 108. Because the coefficient of friction between the mail piece and friction elements 102 and 104 is less than the coefficient of friction between the mail piece and feed belts 212, 214, and 216, the frictional forces between the mail piece and friction elements 102 and 104 will be overcome, allowing the mail piece to pass. In one embodiment, this degree of freedom is rotational about an axis perpendicular to mail path 222. In other embodiments, however, this degree of freedom could be translational or rotational about some other axis.

Friction elements 102 and 104 can also have a downstream end, 114 and 116, respectively. Downstream ends 114 and 116 can have two degrees of freedom. For example, in one embodiment, downstream ends 114 and 116 may be capable of rotating about an axis perpendicular to mail path 222 as well as translating along a line intersecting with mail path 222. As discussed in more detail below, this additional degree of freedom may allow downstream ends 114 and 116 of friction elements 102 and 104 to maintain contact with the mail or move into mail path 222 as upstream ends 110 and 112 rotates away from mail path 222. As the mail piece then moves down mail path 222 and contacts downstream ends 114 and 116, that end, like upstream ends 110 and 112, can also move away from mail path 222. Again, because the coefficient of friction between the mail piece and friction elements 102 and 104 is less than the coefficient of friction between the mail piece and feed belts 212, 214, and 216, the frictional forces between the mail piece and friction elements 102 and 104 will be overcome, allowing the mail piece to pass.

On the other hand, should two or more pieces of mail be overlapping as they pass between feed belts 212, 214, and 216 and double inhibit mechanism 100, the result may be different. For example, where a first and second mail piece are overlapping in mail path 222, the first being adjacent feed belts 212, 214, and 216 and the second being adjacent working surfaces 106 and 108, friction elements 102 and 104, after potentially displacing as a result of the force exerted thereon by the mail pieces, will apply a frictional force to the second mail piece as a result of the friction elements' mechanical bias towards mail path 222. Because the coefficient of friction between working surfaces 106 and 108 and the mail piece is greater than the coefficient of friction between the overlapping mail pieces, the second mail piece can be prevented from passing by double inhibit mechanism 100. The first piece of mail, however, will pass double inhibit mechanism 100 as described above.

In another aspect, because downstream ends 114 and 116 of friction elements 102 and 104 have an additional degree of freedom, even if upstream ends 110 and 112 of friction elements 102 and 104 were to bounce, or temporarily lose contact with mail in mail path 222 as a result of the force with which mail may strike that end of friction elements 102 and 104, downstream ends 114 and 116 can remain in mail path 222 and, during the upstream ends' temporary displacement, still perform the function of preventing overlapping mail from traveling farther down mail path 222.

Once the mail piece has traveled past double inhibit mechanism 100, feed belt assembly 210 can direct it between a pair of take-away belt assemblies 224 and 226. Take-away belt assemblies 224 and 226 are positioned adjacent, or nearly adjacent, one another, such that they exert a normal force on both sides of a single mail piece traveling therebetween. In one aspect, take-away belt assembly 224 can be comprised of two rollers, 240 and 242, and three take-away belts, 228, 230, and 232, in stacked configuration. There need not be three take-away belts, however. For example, in other embodiments, take-away belt assembly 224 may be comprised of one, two, or some other number of belts. Additionally, there may be more than two rollers. Take-away belts 228, 230, and 232 can be comprised of a variety of materials, including, but not limited to, cork, rubber, or polyurethane. Take-away belts used in document transportation and sorting are commonly known in the art, as are the materials from which they may be made. Many of these belts or assemblies can be incorporated into the system described herein.

In another aspect, take-away belts 228, 230, and 232 of belt assembly 224 can be driven by one or both of rollers 240 and 242. In this embodiment, rollers 240 and 242 and belts 228, 230, and 232 rotate in a counter-clockwise direction, but, in other embodiments, it may be desired to rotate the belts in the opposite direction, depending on where the mail pieces are to be directed.

Opposing take-away belt assembly 226 similarly comprises two rollers 244 and 246, and three take-away belts, 234, 236, and 238, in stacked configuration. Like take-away belt assembly 224, in other embodiments, assembly 226 may comprise some other number of belts or rollers. Take-away belts 234, 236, and 238 can be driven by one or both of rollers 244 and 246 and may rotate in a direction opposite opposing belt assembly 224. For example, in this embodiment, while take-away belts 228, 230, and 232 of belt assembly 224 can rotate in a counter-clockwise direction, belts 234, 236, and 238 of belt assembly 226 can rotate in a clockwise direction. In other embodiments, this configuration may be reversed. In this manner, frictional forces acting on opposite sides of a mail piece between belt assemblies 224 and 226, resulting from the normal forces placed on the mail piece by the take-away belts, act in the same direction. As a result, mail pieces between take-away belt assemblies 224 and 226 may be moved in a direction corresponding to the orientation of those assemblies.

In other embodiments, additional pairs of take-away belt assemblies may be positioned adjacent, and end-to-end, belt assemblies 224 and 226. These additional assemblies can be oriented in such a way so as to effect a change in the direction of mail path 222 or otherwise move mail pieces towards a desired destination.

As the separated, or singulated, mail pieces travel between or beyond take-away belt assemblies 224 and 226, other components may be incorporated into the mail sorting process. For example, in one embodiment, an OCR 248, a BCR 250, some other device used in the processing and sorting of mail, or a combination of devices may be located somewhere downstream of double inhibit mechanism 100. Devices of various kinds, implemented in the processing and sorting of mail and incorporated into mail sorting systems, are commonly used and well known in the art. Any one or several of them may be incorporated into the system described herein.

Figure 2:
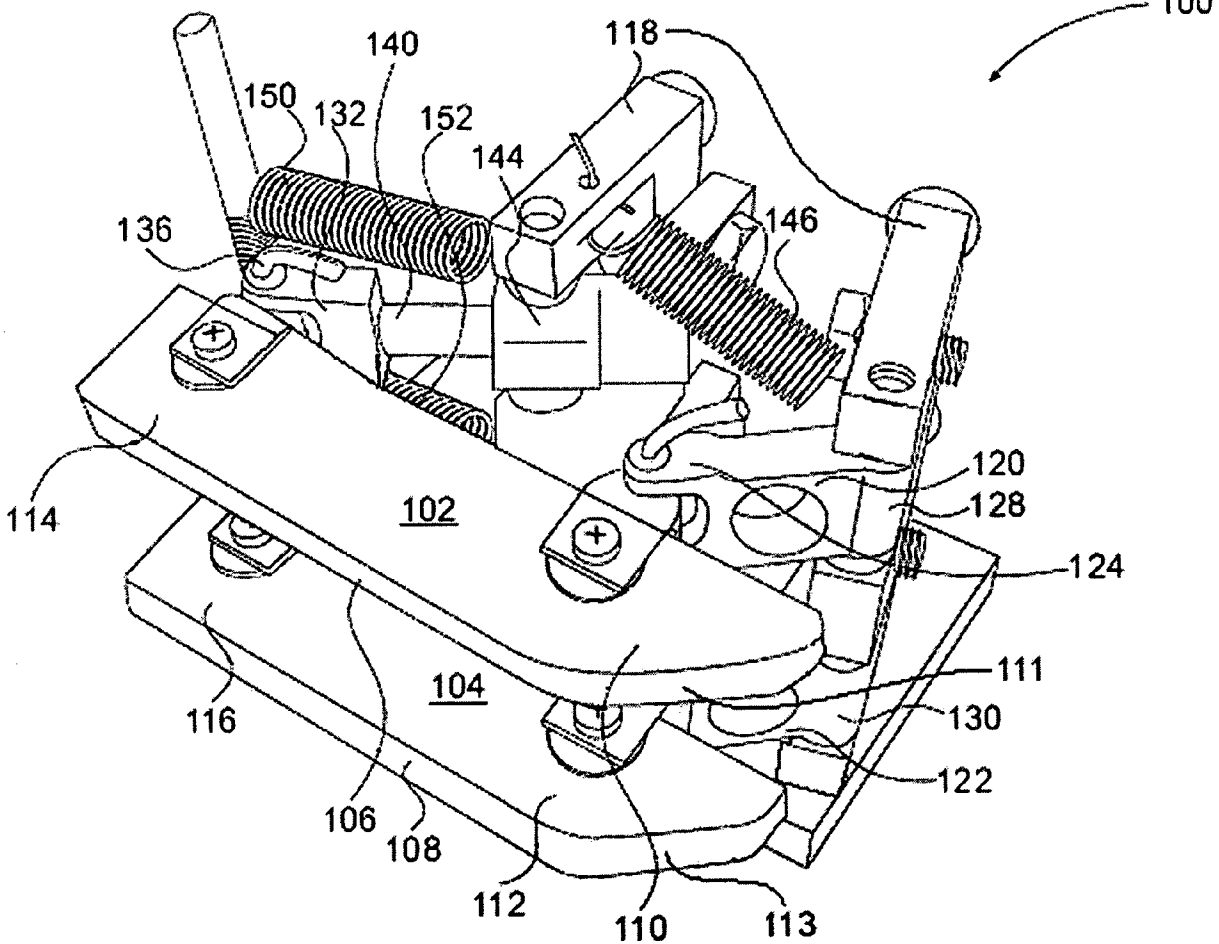
FIG. 2 is a perspective view of the embodiment of FIG. 1.

Referring now to FIG. 2, there is shown a perspective view of a double inhibit mechanism 100, according to one embodiment consistent with the invention. In one aspect, friction elements 102 and 104 can each have an upstream end 110 and 112, a downstream end 114 and 116, and a working surface 106 and 108, respectively. The upstream ends of friction elements 102 and 104 each may have respective tapered edges 111 and 113 facing in the upstream direction. The tapered edges can act to guide mail pieces not in close contact with the feed belts back toward mail path 222 as they approach double inhibit mechanism 100. In another aspect, friction elements 102 and 104 may be mechanically coupled to a mounting frame 118 of double inhibit mechanism 100 at both upstream ends 110 and 112 and downstream ends 114 and 116. For example, in one embodiment, upstream ends 110 and 112 can be coupled to frame 118 via upstream arms 120 and 122, respectively. In one aspect, upstream ends 110 and 112 can be coupled to upstream arms 120 and 122 by pin connections 124 and 126 which can permit rotation about the longitudinal axis of the pins. In other embodiments, however, upstream ends 110 and 112 may be coupled to upstream arms 120 and 122 via some other rotatable connection.

In another aspect, the opposing ends of upstream arms 120 and 122 can be similarly coupled to frame 118 by pin connections 128 and 130 which can permit rotation about the longitudinal axis of those pins. Again, however, in other embodiments, this rotation may be achieved using some other type of connection or upstream arms 120 and 122 may be fixed to frame 118 by some type of translational connection, such as a piston and bushing connection. In this embodiment, through pin connections 124, 126, 128 and 130, upstream ends 120 and 122 of friction elements 102 and 104 may rotate away from mail path 222 when a mail piece contacts working surface 106 or 108, allowing the mail piece to slide therepast.

In like fashion, downstream ends 114 and 116 of friction elements 102 and 104 can be rotationally coupled to downstream arms 132 and 134, respectively, via a rotational connection, such as pin connections 136 and 138. However, unlike upstream arms 120 and 122 that are only rotationally or translationally mounted to frame 118, downstream arms 132 and 134 can be coupled to the frame using a connection that affords both translational and rotational movement. For example, in this embodiment, downstream arms 132 and 134 are each comprised of a respective piston 140 and 142 extending through a respective bushing 144 and 146. This piston and bushing connection may allow downstream ends 114 and 116 of friction elements 102 and 104 to translate along the longitudinal axis of downstream arms 132 and 134. Additionally, bushings 144 and 146 can be rotationally mounted to the frame. As a result, downstream ends 114 and 116 of friction elements 102 and 104 can have two degrees of freedom and may not only rotate away from the mail path to allow a single mail piece to pass thereby, but may also translate into the mail path in response to the upstream ends' rotation or translation away therefrom. In this manner, it can be ensured that friction elements 102 and 104 do not lose contact with mail path 222, even when a mail piece contacts upstream ends 110 and 112 and causes those ends to bounce, or temporarily displace, away from mail traveling along the feed belts.

In another aspect of the embodiment depicted in FIG. 2, springs 146 and 148 can be connected to upstream arms 120 and 122. The ends of the springs opposite the arms can be anchored to frame 118 or some other non-moving structure. These springs can serve to mechanically bias upstream arms 120 and 122 in an extended position, urging the upstream ends of friction elements 102 and 104 towards the feed belts in such a way so as to ensure an adequate normal force is exerted on any mail pieces traveling down mail path 222. Alternatively, other embodiments may incorporate different methods of mechanically biasing upstream arms 120 and 122 towards the feed belts.

In another aspect, springs 150 and 152 similarly bias downstream arms 132 and 134 in an extended position, urging downstream ends 114 and 116 of friction elements 102 and 104 towards the feed belts. Alternatively, other embodiments may incorporate different methods of mechanically biasing downstream arms 132 and 134 and friction elements 102 and 104 toward the feed belts.

Figure 3:
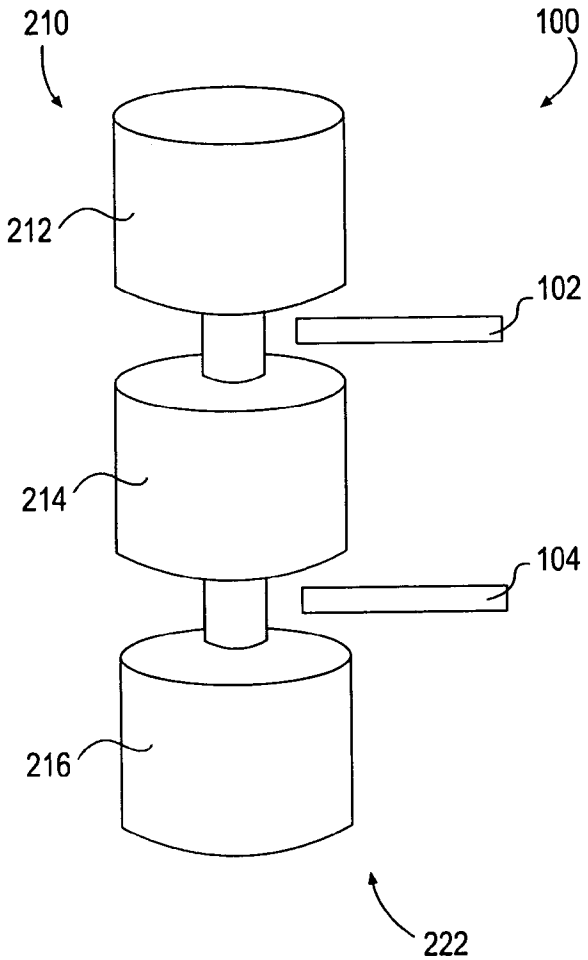
FIG. 3 is a front view of the embodiment of FIG. 1.

FIG. 3 depicts mail path 222 between feed belts 212, 214, and 216 of feed belt assembly 210 and friction elements 102 and 104 of double inhibit mechanism 100. In one aspect, friction elements 102 and 104 are nested between feed belts 212, 214, and 216 so as to eliminate any gap therebetween, thus reducing the risk of more than one mail piece passing between feed belt assembly 210 and double inhibit mechanism 100. In other embodiments, friction elements 102 and 104 need not be nested within feed belts 212, 214, and 216, but may be adjacent, or nearly adjacent, the belts. As used herein, "nearly adjacent" is used to describe such a distance between the feed belts and the friction elements that, although not in contact with one another, both are positioned so as to make contact with opposing sides of a single mail piece passing therebetween. Additionally, as mentioned above, there need not be three feed belts and two friction elements. In other embodiments, for example, there may a single feed belt opposing a single friction element or any combination of a plurality of feed belts and friction elements. For clarity, all figures accompanying this disclosure will depict friction elements 102 and 104 as adjacent, or nearly adjacent feed belts 212, 214, and 216. This representation should be interpreted to include embodiments wherein friction elements 102 and 104 and feed belts 212, 214, and 216 are nested.

Figure 4:
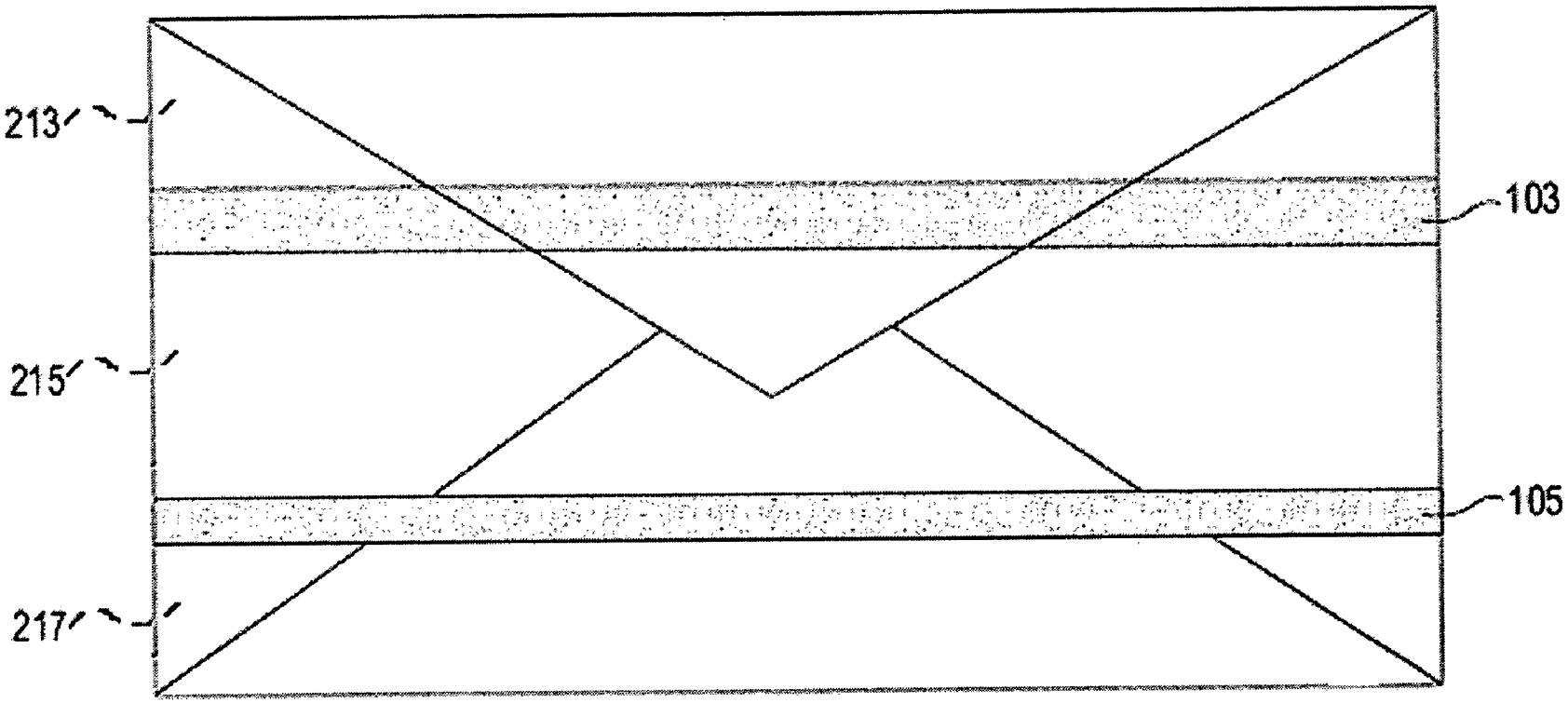
FIG. 4 is a rear view of a mail piece.
Figure 5A:
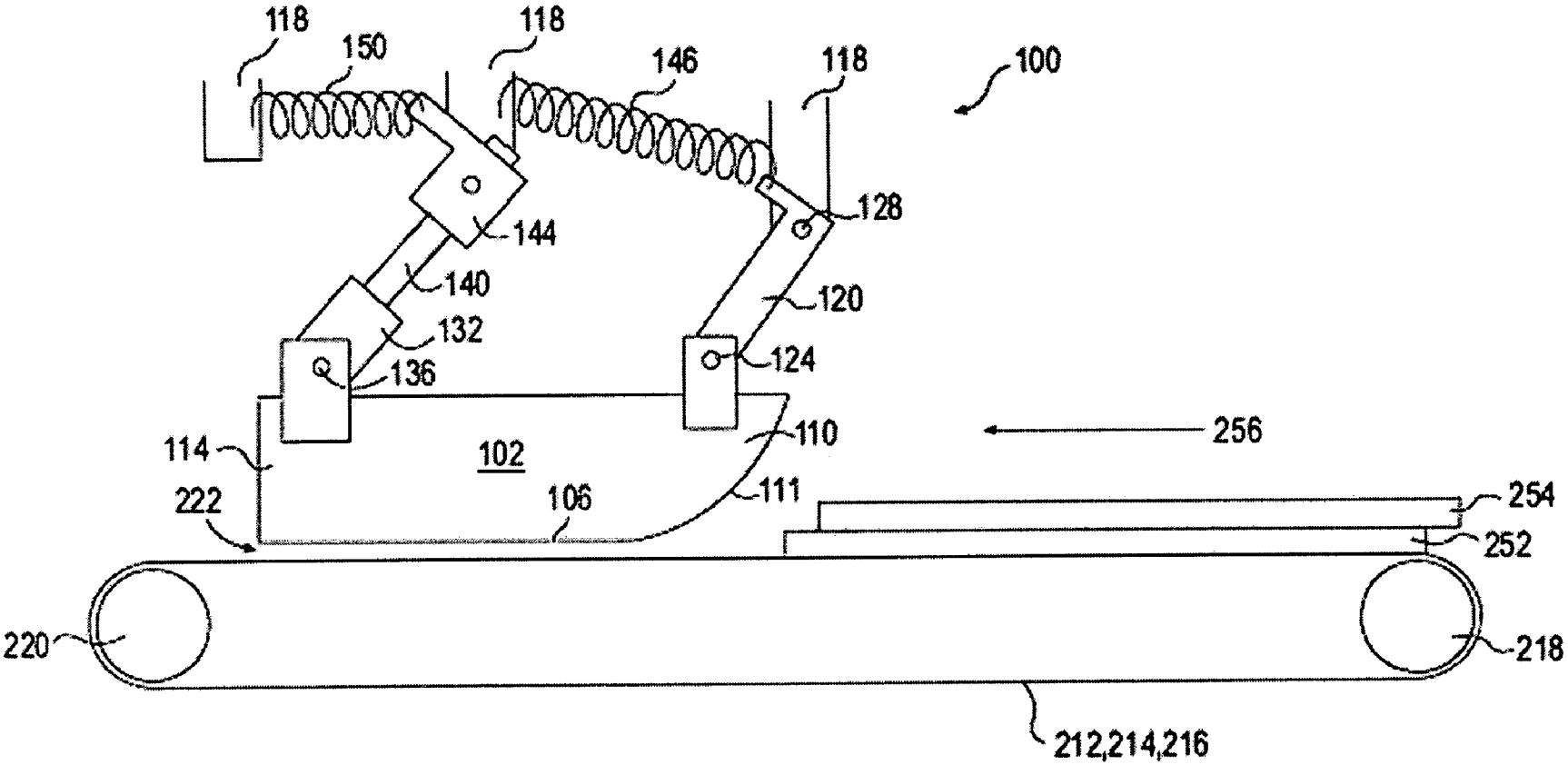
FIG. 5(*a*)-(*d*) are detailed top views of the embodiment of FIG. 1.
Figure 5B:
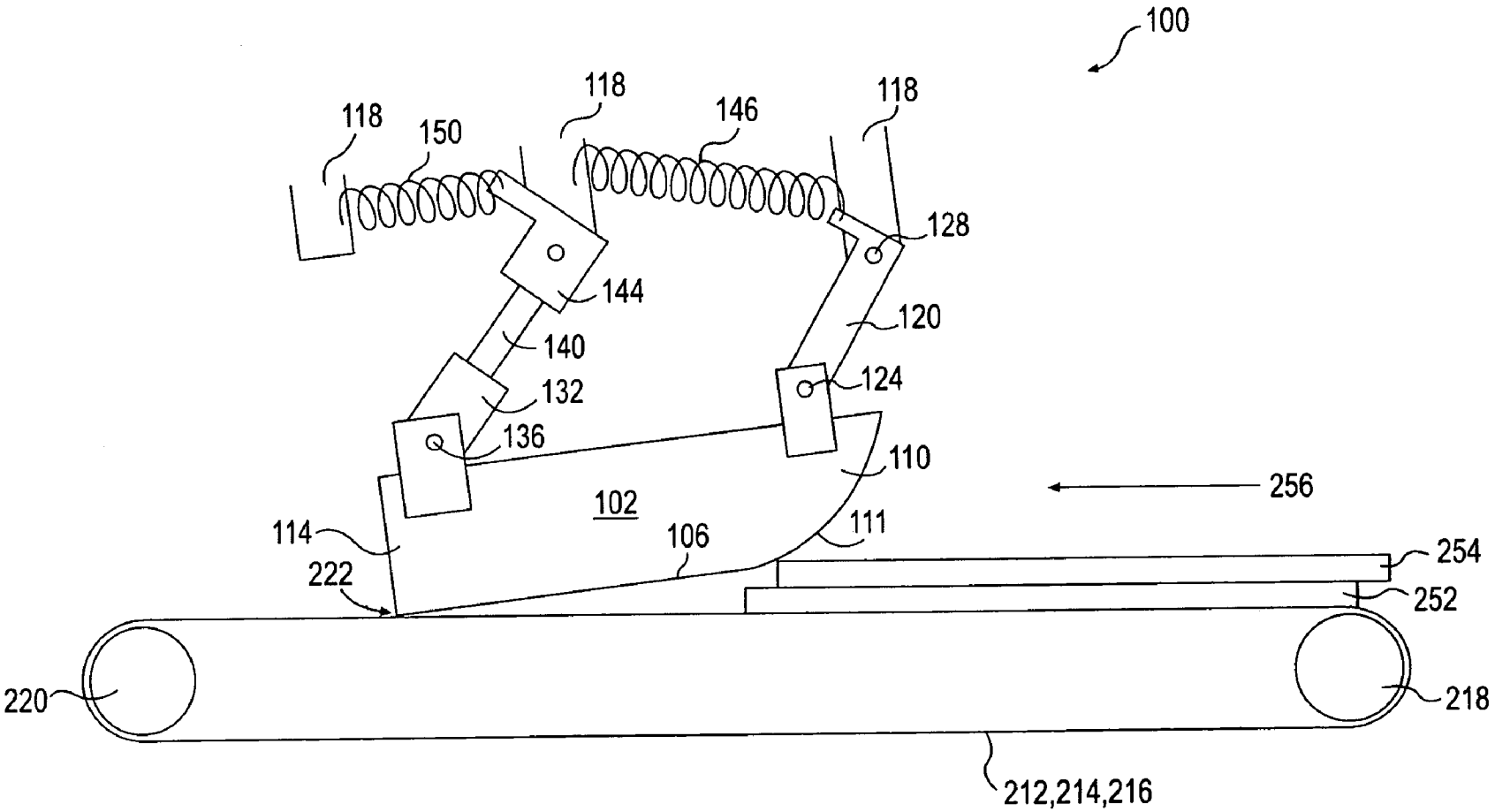
Figure 5C:
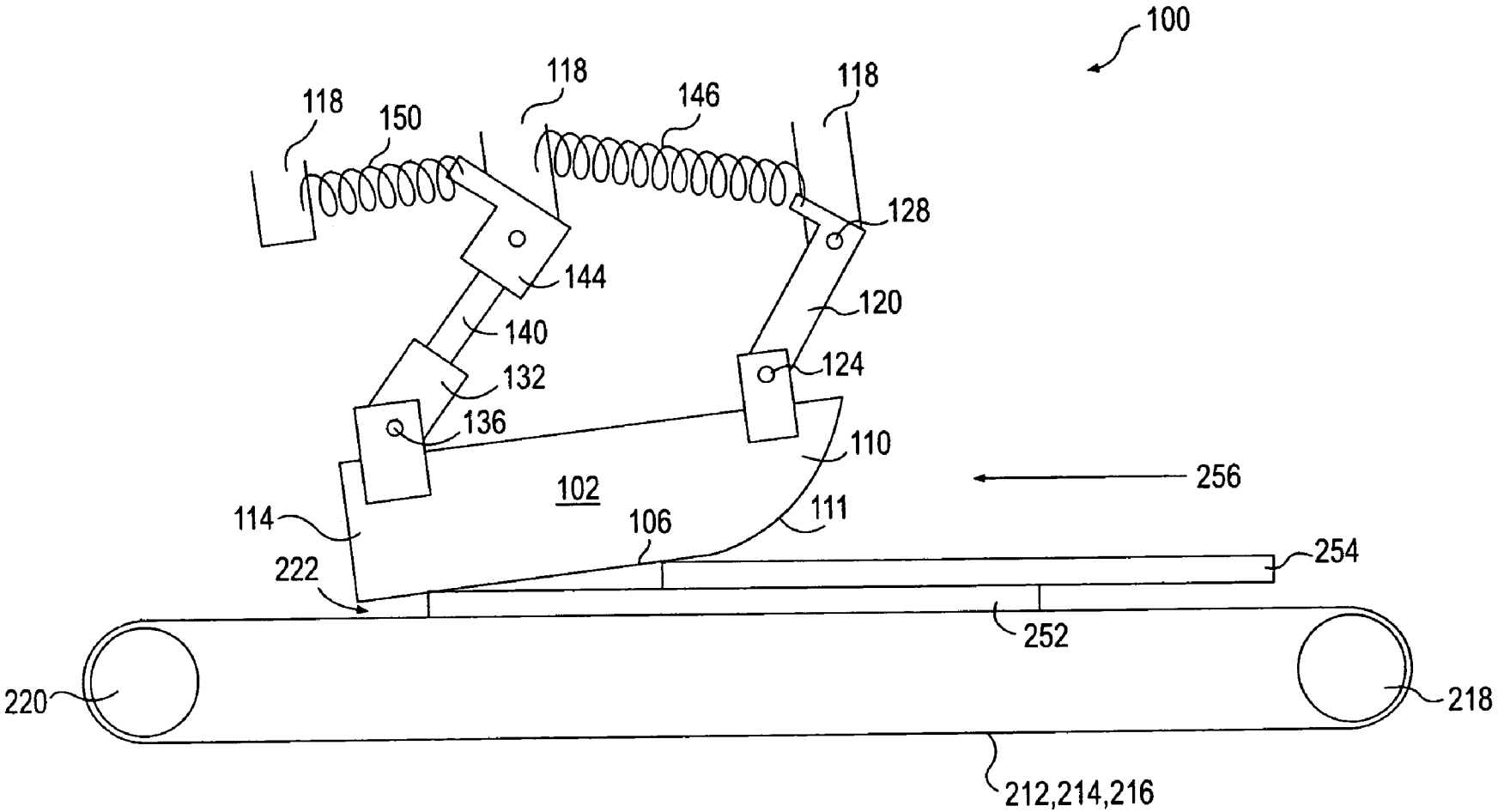
Figure 5D:
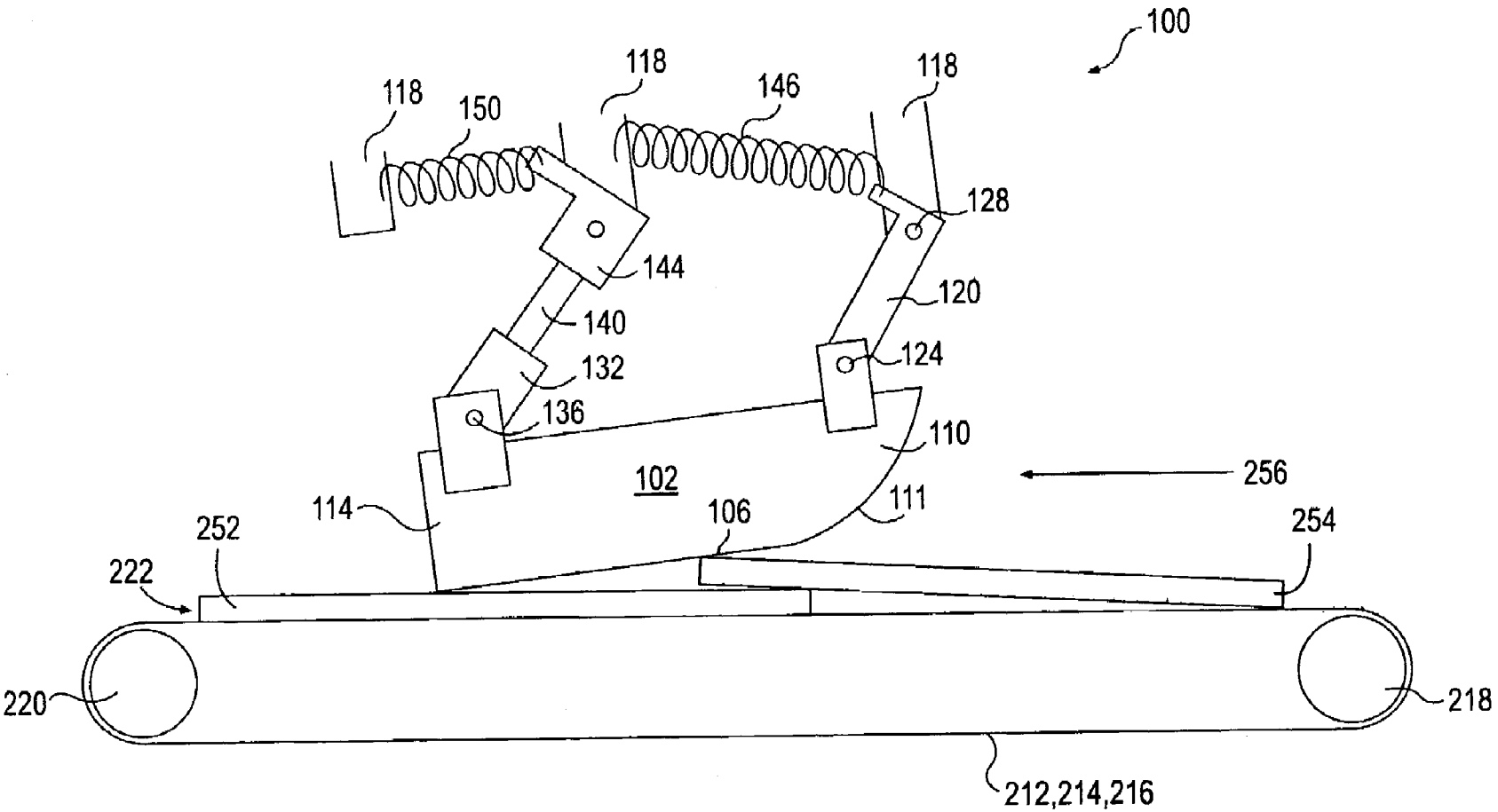

FIG. 4 depicts the contact between feed belts 212, 214, and 216 and a mail piece in mail path 222, as well as the contact between friction elements 102 and 104 and the opposing side of the same mail piece. In one embodiment, feed belts 212, 214 and 216 can contact three bands 213, 215 and 217, respectively, across the side of the mail piece facing the belts. The normal force exerted by feed belts 212, 214, and 216 on the mail piece, resulting from the mechanical bias of friction elements 102 and 104 pushing the mail piece against the belts, can create frictional forces along those bands, acting in the direction of the belts' rotation. On the opposing side of the mail piece, the side facing away from feed belts 212, 214, and 216, the normal force exerted by friction elements 102 and 104 can create frictional forces along bands 103 and 105, respectively, lying between the areas contacted by feed belts 212, 214, and 216 and acting in the direction opposite the feed belts' rotation. Obviously, the location of these frictional forces will depend on the number, width, and orientation of the feed belts and friction elements 102 and 104. In other embodiments, different belt and friction element configurations can result in different bands of contact with the mail pieces.

FIGS. 5(*a*)-(*d*) depict the movements of one embodiment of double inhibit mechanism 100 as overlapping mail pieces travel down mail path 222 in the direction shown by arrow 256. In FIG. 5(*a*), mail piece 252 can be immediately adjacent feed belts 212, 214, and 216. Overlapping mail piece 254 can be immediately adjacent mail piece 252. For clarity, only one friction element, friction element 102, is shown. FIG. 5(*a*) also shows friction element 102 at rest, or prior to contact with any mail piece. In one aspect, working surface 106 of friction element 102 can be substantially parallel to mail path 222. In another aspect, friction element 102 can be either nested with, adjacent, or nearly adjacent one or more of feed belts 212, 214, and 216. Upstream arm 120 and downstream arm 132 may mechanically couple friction element 102 to frame 118. As discussed above, there are a variety of ways to achieve such a coupling. In this embodiment, the end of upstream arm 120 closest friction element 102 can be rotatably mounted to upstream end 110 of friction element 102 via pin connection 124. Similarly, the end of downstream arm 132 closest friction element 102 can be rotatably mounted to downstream end 114 of friction element 102 via pin connection 136. The opposite end of upstream arm 120 may also be rotatably mounted to frame 118 at pin connection 128. The opposite end of downstream arm 132, on the other hand, can be comprised of piston 140 extending through bushing 144, which may be rotatably fixed to frame 118. Thus, the connection between downstream arm 132 and frame 118 can have two degrees of freedom, one rotational and one translational. Springs 146 and 150 can be mounted to the frame and connected to upstream arm 120 and downstream arm 132, respectively, at their ends farthest from friction element 102. In this fashion, springs 146 and 150 can mechanically bias friction element 102 towards mail path 222 and provide a normal force acting against any mail piece that travels therepast.

FIG. 5(*b*) depicts friction element 102 of double inhibit mechanism 100 as overlapping mail pieces 252 and 254 make contact with tapered edge 111 of upstream end 110. In this embodiment, contact with mail pieces 252 and 254 can cause upstream end 110 to rotate away from mail path 222 through rotation about pin connections 124 and 128. In another aspect, as a result of the two degrees of freedom at the connection of downstream arm 132 and frame 118, the upstream end's rotation away from mail path 222 can cause downstream end 114 to translate, via the piston 140 and bushing 144 connection, into mail path 222.

FIG. 5(*c*) shows double inhibit mechanism 100 as overlapping mail pieces 252 and 254 contact working surface 106 of friction element 102. In one aspect, as overlapping mail pieces 252 and 254 come into contact with downstream end 114 of friction element 102, downstream end 114 can rotate about pin connection 136 and bushing connection 144 such that downstream end 114 moves away from mail path 222, and working surface 106 is substantially adjacent mail piece 254. In another aspect, the normal force that friction element 102 can exert on the mail pieces as a result of biasing springs 146 and 150 can create a retarding frictional force on mail piece 254. Because the coefficient of friction between working surface 106 and mail piece 254 is greater than that between mail piece 252 and mail piece 254, the frictional forces impeding mail piece 254 from traveling down mail path 222 are greater than those urging it past double inhibit mechanism 100. As a result, mail piece 254 can be prevented from sliding past friction element 102.

FIG. 5(*d*) shows mail piece 254 stripped from mail piece 252 and immediately adjacent feed belts 212, 214, and 216. In one aspect, as the coefficient of friction between mail piece 252 and feed belts 212, 214, and 216 is greater than that between mail piece 252 and friction element 102, the frictional forces exerted by double inhibit mechanism 100 can be overcome and mail piece 252 can slide past friction element 102 and down mail path 222.

Figure 6A:
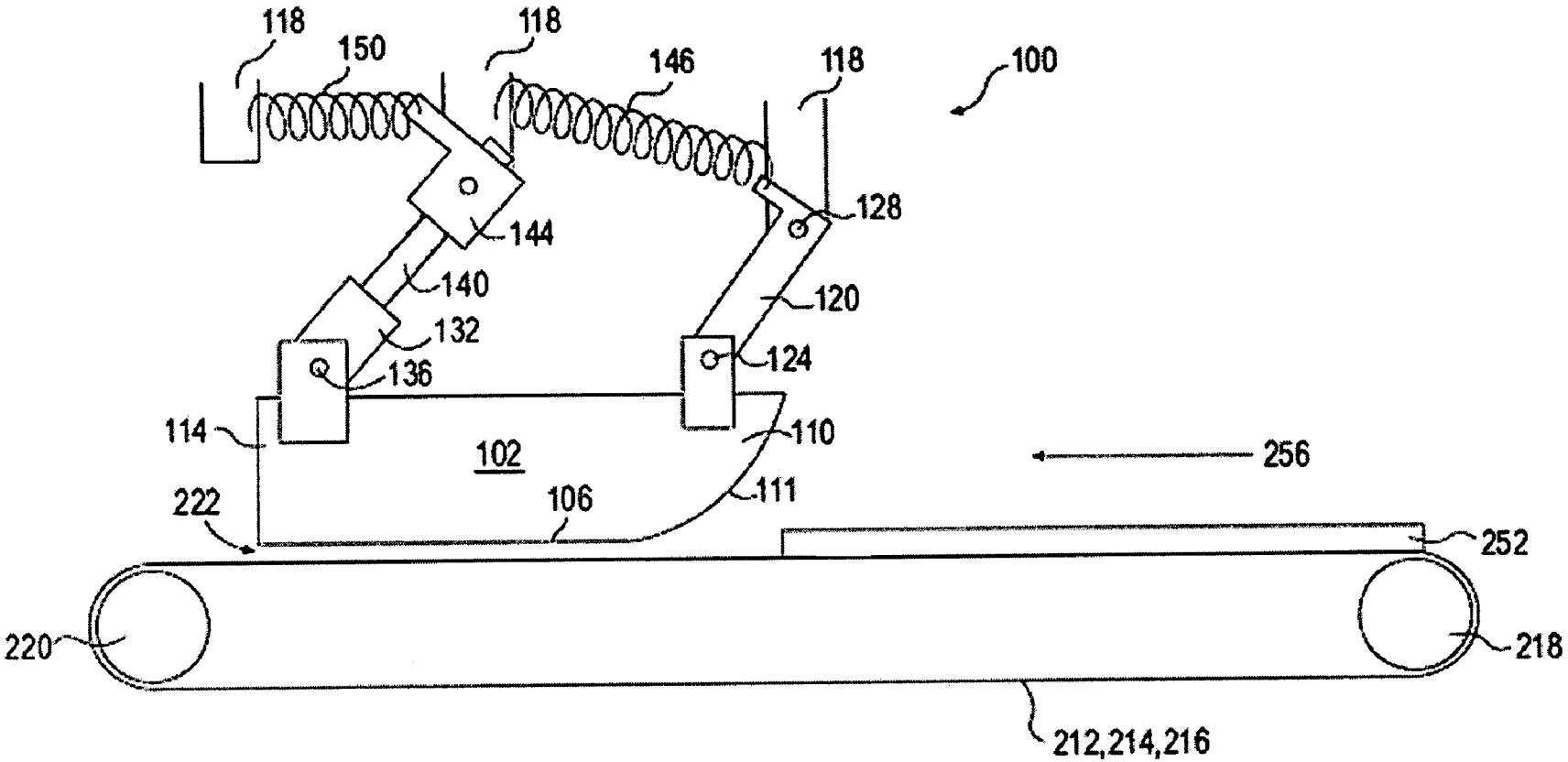
FIG. 6(*a*)-(*c*) are further detailed tops view of the embodiment of FIG. 1.
Figure 6B:
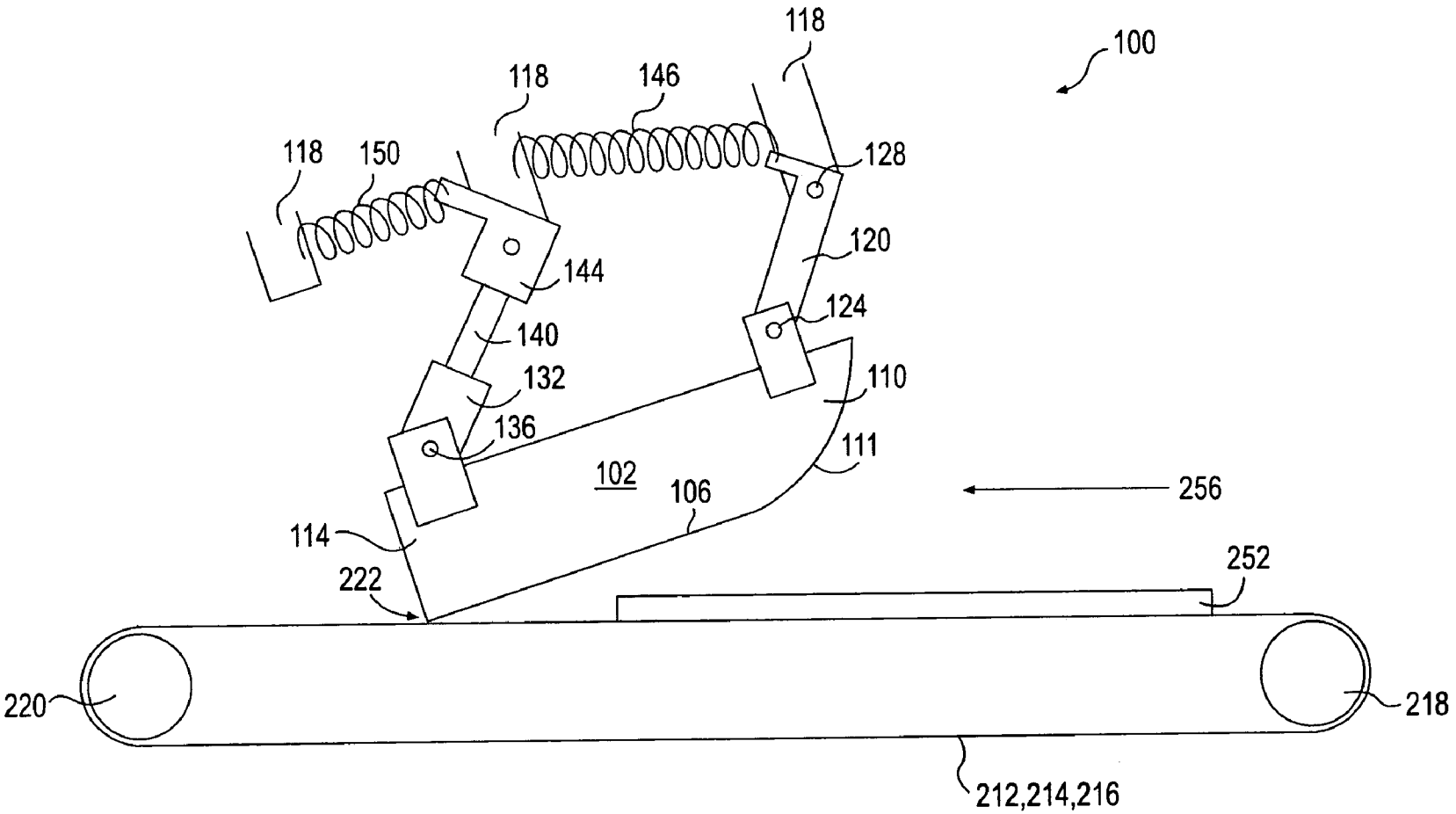
Figure 6C:
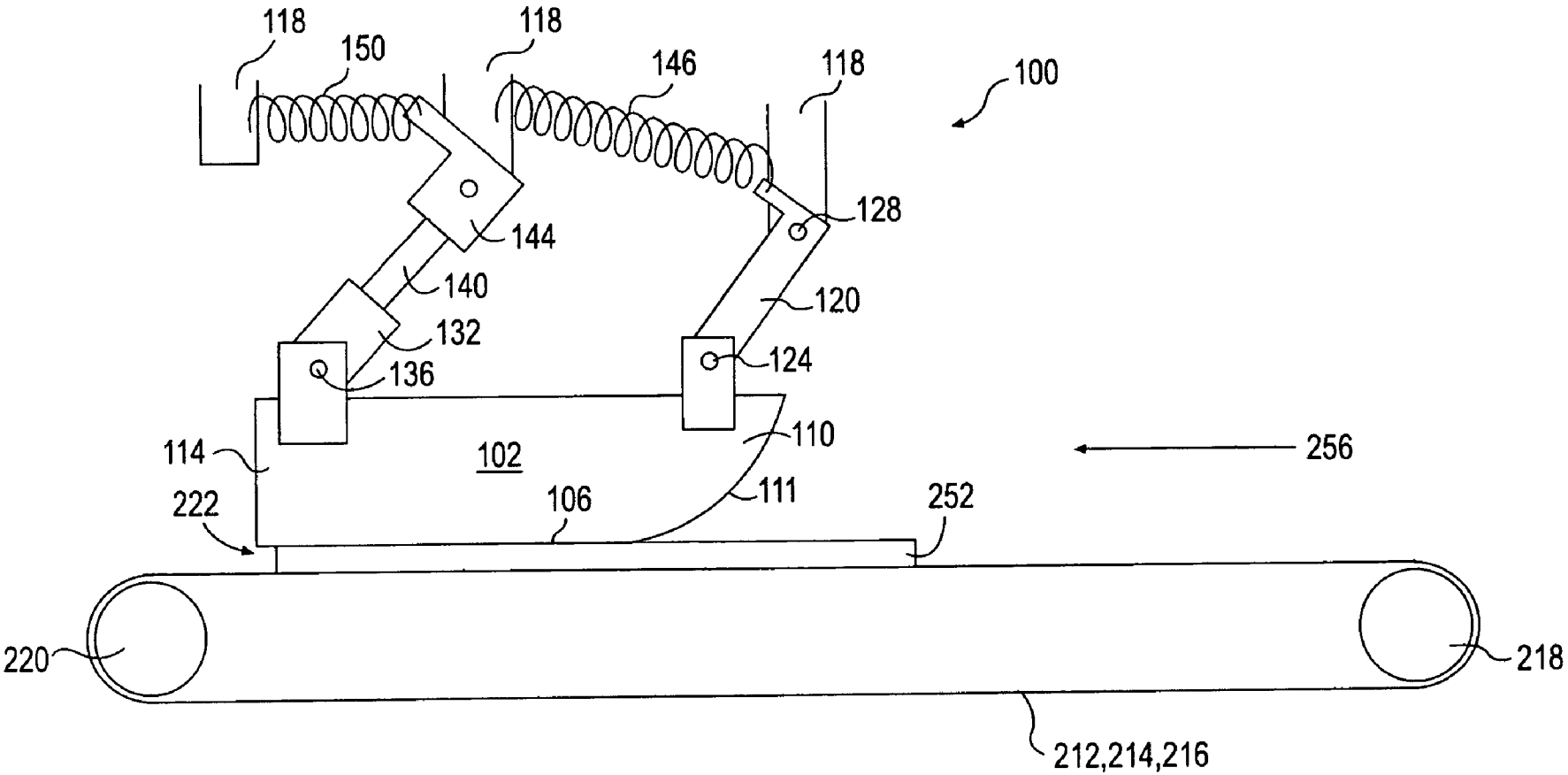

FIGS. 6(*a*)-(*c*) depict the movement of friction element 102 when mail piece 252, traveling down mail path 222 in the direction shown by arrow 256, strikes upstream end 110 with sufficient force to cause friction element 102 to bounce, or temporarily lose contact with mail in mail path 222. Again, for clarity, only one friction element, friction element 102, is shown.

Referring to FIG. 6(*a*), mail piece 252, depicted prior to contact with double inhibit mechanism 100, can be immediately adjacent feed belts 212, 214, and 216. Similar to FIG. 5(*a*), friction element 102 may be in its at-rest position. That is, the friction element may be biased in the direction of mail path 222 where it is either nested with, adjacent, or nearly adjacent feed belts 212, 214, and 216. In another aspect, upstream arm 120 and downstream arm 132, in this embodiment, can be mechanically coupled to frame 118 in the same fashion as described in regards to FIG. 5(*a*). Thus, upstream end 110 of friction element 102 can rotate out of mail path 222 about pin connections 124 and 128 and downstream end 114 can both rotate about pin 136 and rotatable bushing 144 as well as translate along the longitudinal axis of piston 140.

FIG. 6(*b*), in another aspect, shows friction element 102 some time after mail piece 252 has contacted upstream end 110. The force with which mail piece 252 can strike friction element 102 can be sufficient to cause upstream end 110 to rotate about pin connections 124 and 128 such that upstream end 110 can displace from mail path 222 and lose contact with mail pieces therein. However, as a result of the way in which friction element 102 is coupled to double inhibit mechanism 100, the rotation of upstream end 110 of friction element 102 away from mail path 222 may cause downstream end 114 to translate, along piston 140, into mail path 222. As a result, rather than such an upstream bounce causing a similar displacement away from mail path 222 at downstream end 114 of friction element 102, in this embodiment, at least a portion of friction element 102 can remain in contact with mail in mail path 222 and thus prevent overlapping mail pieces from passing thereby before spring-biased upstream end 110 has returned to its at-rest position nested with, adjacent, or nearly adjacent feed belts 212, 214, and 216.

Referring now to FIG. 6(*c*), mail piece 252 can contact downstream end 114 of friction element 102 which, in response, can rotate away from mail path 222 while still maintaining contact with mail piece 252. The normal force imparted on mail piece 252 as a result of the spring-bias of friction element 102 towards mail path 222 results in frictional forces between both feed belts 212, 214, and 216 and the side of mail piece 252 facing the belts as well as working surface 106 and the side of the mail piece facing friction element 102. Because the coefficient of friction between friction element 102 and mail piece 252 is less than that between feed belts 212, 214, and 216 and mail piece 252, the frictional forces imparted by working surface 106, retarding the mail piece's progress down mail path 222, are overcome by those imparted by feed belts 212, 214, and 216, urging the mail piece past double inhibit mechanism 100. As a result, mail piece 252 is able to pass by friction element 102 and continue down mail path 222.

In another aspect of the embodiments described herein, some or all of the pivoting joints, e.g., pin connections 124, 128 and 136, can be self-lubricating through the use of plastic bushings on one or both sides of the connection. In other embodiments, however, self-lubricating bushings comprised of another material may be used. Alternatively, some other type of lubrication, such as an external oil or grease, may be used.

Similarly, in another aspect, bushing 144 may also comprise a self-lubricating component, such as an inner plastic bushing, or some external lubricant to ensure proper translation of piston 140. Additionally, it may be desired to select bushings, materials, and lubricants such that the piston-bushing connection exhibits a lower coefficient of friction than one or more of the pin connections elsewhere in double inhibit mechanism 100. In such an embodiment, it may be further ensured that a rotation of the upstream end of the friction element about pin connections 124 and 128 results in the translation into the mail path of the downstream end of the friction element, as a result of piston 140 extending from bushing 144, before rotation of that end about pin connection 136 and rotatable bushing 144 away from the mail path takes place.

Other embodiments of double inhibit mechanism 100 disclosed herein may also incorporate quick-release type connections for joining the friction elements to the upstream and downstream arms. Due to wear on the working surface, friction elements are replaced relatively frequently, especially when a large volume of mail is being processed. As a result, it may be desired to incorporate connections that would allow for fast and simple replacement of the worn out elements so as to minimize system downtime, human interaction, and risks associated with complex installation procedures.

Again, it should also be noted that, although the system described herein is discussed primarily in relation to the processing and sorting of mail pieces, this system can be incorporated into any process the goal of which is to singulate documents or avoid the overlapping of items in a feed path.

Other embodiments will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A double inhibit mechanism for use in the processing of items, comprising:

a mounting frame;

a friction element having an upstream end, a downstream end, and a working surface, the friction element being mechanically coupled to the mounting frame such that the downstream end has at least two degrees of freedom;

an item feed path, one side of the feed path being defined by the working surface; and a biasing mechanism mechanically biasing the friction element towards the feed path wherein the upstream end of the friction element can rotate away from the item feed path.

2. The double inhibit mechanism of claim 1, wherein the friction element is mechanically coupled to the mounting frame such that the upstream end of the friction element has at least one degree of freedom.

3. The double inhibit mechanism of claim 1, wherein the friction element is mechanically coupled to the mounting frame such that the downstream end of the friction element can rotate and translate away from the feed path.

4. The double inhibit mechanism of claim 1, wherein the friction element is mechanically coupled to the mounting frame such that the upstream end of the friction element can translate away from the feed path.

5. The double inhibit mechanism of claim 1, wherein the friction element is mechanically coupled to the mounting frame such that the downstream end of the friction element can converge upon or maintain its relationship with the feed path as the upstream end of the friction element moves away from the feed path.

6. A device for singulating documents, comprising:

a mounting frame;

a friction element having an upstream end, a downstream end, and a working surface, the friction element being mechanically coupled to the mounting frame by an upstream arm, having a first end and a second end, and a downstream arm, having a first end and a second end, such that the downstream end has at least two degrees of freedom and the upstream end has at least one degree of freedom;

a document feed path, one side of the feed path being defined by the working surface; and a biasing mechanism mechanically biasing the friction element towards the feed path.

7. The device of claim 6, wherein the first end of the upstream arm is rotatably coupled to the friction element at or near the upstream end and the second end of the upstream arm is rotatably coupled to the mounting frame.

8. The device of claim 6, further comprising self-lubricating bushings adjacent the first and second ends of the upstream arm.

9. The device of claim 6, further comprising at least one self-lubricating bushing adjacent the first end of the downstream arm.

10. The device of claim 6, wherein the downstream arm comprises a piston.

11. The device of claim 10, wherein the first end of the downstream arm is rotatably coupled to the friction element at or near the downstream end and the second end of the downstream arm is at least partially maintained in a downstream arm bushing.

12. The device of claim 11, wherein the downstream arm bushing is rotatably coupled to the mounting frame.

13. The device of claim 11, further comprising at least one self lubricating bushing adjacent the downstream arm bushing.

14. The device of claim 6, further comprising a spring coupled to the upstream arm such that the upstream arm is biased towards the feed path.

15. The device of claim 6, further comprising a spring coupled to the downstream arm such that the downstream arm is biased towards the feed path.

16. The device of claim 6, further comprising a first spring coupled to the upstream arm such that the upstream arm is biased towards the feed path and a second spring coupled to the downstream arm such that the downstream arm is biased towards the feed path.

17. The device of claim 6, wherein the upstream end of the friction element is tapered.

18. A system for separating overlapping mail pieces in a mail path, comprising:

a feed belt assembly having a feed belt; and a double inhibit mechanism comprising a friction element having an upstream end, a downstream end, and a working surface, wherein:

the working surface lies in a plane substantially parallel to a plane in which the feed belt lies; and the downstream end of the feed path has at least two degrees of freedom and the upstream end of the friction element can rotate away from the feed path.

19. The system of claim 18, comprising at least two feed belts.

20. The system of claim 19, wherein the friction element is nested between the feed belts.

21. The system of claim 19, wherein the friction element is adjacent the feed belts.

22. The system of claim 19, wherein the friction element is nearly adjacent the feed belts.

23. The system of claim 18, comprising at least three feed belts and at least two friction elements.

24. The system of claim 23, wherein the friction elements are nested between the feed belts.

25. The system of claim 23, wherein the friction elements are adjacent the feed belts.

26. The system of claim 23, wherein the friction elements are nearly adjacent the three feed belts.

27. The system of claim 18, wherein the feed belt is comprised of a material selected from the group consisting of a rubber, cork, and polyurethane.

28. The system of claim 18, wherein the friction element is comprised of a material selected from the group consisting of a rubber, cork, stone, and polyurethane.

* * * * *